US006857421B2

(12) United States Patent
Adler et al.

(10) Patent No.: US 6,857,421 B2
(45) Date of Patent: Feb. 22, 2005

(54) METHOD FOR OPERATING A DIESEL ENGINE, AND DIESEL ENGINE

(75) Inventors: Holger Adler, Stuttgart (DE); Nicholas Fekete, Fellbach (DE); Michael Lenz, Fellbach (DE); Thomas Liebscher, Fellbach (DE); Ulrich Merten, Le-Echterdingen (DE); Sven Pfoertsch, Munich (DE); Norbert Ruzicka, Steinenbronn (DE)

(73) Assignee: DaimlerChrysler AG, Stuttgart (DE)

( * ) Notice: Subject to any disclaimer, the term of this patent is extended or adjusted under 35 U.S.C. 154(b) by 55 days.

(21) Appl. No.: 10/307,264

(22) Filed: Nov. 29, 2002

(65) Prior Publication Data

US 2003/0150425 A1 Aug. 14, 2003

Related U.S. Application Data

(63) Continuation-in-part of application No. PCT/EP01/04798, filed on Apr. 28, 2001.

(51) Int. Cl.[7] ..... F02D 41/00; F02M 7/00

(52) U.S. Cl. ..... 123/681; 123/443; 123/493; 123/436

(58) Field of Search ..... 123/295, 305, 123/443, 568.11, 568.14, 435, 436, 492, 493, 681; 701/110, 111

(56) References Cited

U.S. PATENT DOCUMENTS

| | | | | | |
|---|---|---|---|---|---|
| 5,778,856 | A | * | 7/1998 | Okada et al. | 123/406.47 |
| 5,813,386 | A | * | 9/1998 | Okada et al. | 123/339.14 |
| 5,881,693 | A | * | 3/1999 | Mizuno | 123/295 |
| 5,947,079 | A | * | 9/1999 | Sivashankar et al. | 123/295 |
| 6,019,082 | A | * | 2/2000 | Mashiki et al. | 123/308 |
| 6,026,779 | A | * | 2/2000 | Obata et al. | 123/295 |
| 6,050,238 | A | * | 4/2000 | Suzuki et al. | 123/295 |
| 6,178,945 | B1 | * | 1/2001 | Suzuki et al. | 123/295 |
| 6,209,526 | B1 | * | 4/2001 | Sun et al. | 123/481 |
| 6,302,081 | B1 | * | 10/2001 | Moser et al. | 123/295 |
| 2003/0182934 | A1 | * | 10/2003 | Adler et al. | 60/286 |

FOREIGN PATENT DOCUMENTS

| | | | | |
|---|---|---|---|---|
| DE | 195 43 219 | | 12/1996 | |
| DE | 196 36 790 | | 3/1998 | |
| DE | 197 50 226 | | 10/1998 | |
| DE | 198 24 915 | | 2/1999 | |
| DE | 197 53 718 | | 7/1999 | |
| DE | 199 13 949 | | 10/1999 | |
| DE | 199 14 787 | | 10/1999 | |
| EP | 0 732 485 | | 9/1996 | |
| EP | 0 872 633 | | 10/1998 | |
| EP | 0 916 829 | | 5/1999 | |
| JP | 49046 | * | 2/1995 | F02D/41/14 |
| JP | 10 141048 | | 5/1998 | |
| JP | 10 252523 | | 9/1998 | |
| JP | 8927 | * | 1/2000 | F02D/41/04 |
| JP | 27710 | * | 1/2000 | F02D/41/04 |

* cited by examiner

*Primary Examiner*—Hai Huynh
(74) *Attorney, Agent, or Firm*—Klaus J. Bach

(57) ABSTRACT

In a method for operating a diesel engine and a diesel engine, wherein engine emission control is provided by switching between a lean mode with superstoichiometric combustion air ratio $\lambda>1$ and a rich mode with substoichiometric combustion air ratio $\lambda<1$, the engine-torque fluctuations during the switching are determined and engine parameters which influence the engine torque, are adjusted so as to keep the engine torque constant during the switchover.

15 Claims, 1 Drawing Sheet

METHOD FOR OPERATING A DIESEL ENGINE, AND DIESEL ENGINE

This is a continuation-in-part application of international PCT/EP01/04798 filed Apr. 28, 2001 and claiming the priority of German application 100 26 806.4 filed May 05, 2000.

BACKGROUND OF THE INVENTION

The invention relates to a method for operating a diesel engine, which involves switching between a lean mode with superstoichiometric combustion air ratio $\lambda>1$ and a rich mode with substoichiometric combustion air ratio $\lambda<1$.

Devices for adsorbing nitrogen oxide ($NO_x$) are used to clean the exhaust gas of diesel engines. Under certain conditions, e.g. available storage capacity, active temperature window, $NO_x$ adsorber systems store the nitrogen oxides from internal combustion engines during lean combustion, i.e. superstoichiometric combustion with $\lambda>1$ and residual oxygen in the exhaust gas. $NO_x$ adsorber systems also store the sulfur which is present in the fuel and engine oil in the form of sulfates ($SO_x$). On account of the higher chemical bonding forces, the sulfates undesirably occupy the storage areas for the nitrogen oxides. To regenerate $NO_x$ adsorber systems of this type, i.e. to desorb $NO_x$ and, at the same time, convert $NO_x$ and to desorb $SO_x$ and at the same time convert $SO_x$, oxygen-free exhaust gas with $\lambda<1$ and the highest possible reducing-agent content is required. Regeneration of an $NO_x$ adsorber system of this nature can be realized by temporarily rich engine operation, i.e. with substoichiometric combustion with $\lambda<1$.

Patent DE 195 43 219 C1 describes a method for operating a diesel engine which involves switching between a lean mode with superstoichiometric combustion air ration $\lambda>1$ and a rich mode with substoichiometric combustion air ratio $\lambda<1$. The switching is carried out in order to regenerate an exhaust-gas cleaning installation with an $NO_x$ adsorber system. The switching from lean mode to rich mode is effected by electronically controlled exhaust gas recirculation, intake air throttling, additional injection of fuel and an increase in the exhaust gas back pressure.

Patent DE 197 50 226 C1 describes an engine control system for a diesel engine in which the switching between lean mode and rich mode is simultaneously accompanied by switching between stored characteristic diagrams for the lean mode and characteristic diagrams for the rich mode. The intention of this method, inter alia, is that the driver should not be disturbed by, or notice, the switching between lean mode and rich mode. However, the diesel engine only supplies approximately the same output as in the corresponding lean mode within a limited range of the rich mode, and consequently an unnoticed change between the operating modes can only take place within this limited range.

Patent DE 197 53 718 C1 describes a method for operating a diesel engine in which the diesel engine is only switched from lean mode to rich mode when there is a steady-state or quasi-steady-state engine operating mode present. The intention of this is that the driver should not notice any change in the power provided by the diesel engine during the switching. If there are non-steady-state engine operating conditions in rich mode, the engine is switched back from rich mode to lean mode. Both characteristic diagrams for lean mode and for rich mode of the diesel engine are stored in a memory in the engine management system.

DE 196 36 790 A1 describes the setting of a Diesel engine to produce a rich exhaust-gas mixture. In such a way power losses as a result of the rich exhaust-gas mixture are prevented in that the rich mixture is set only under a low load, under engine overrun conditions or during idling.

In DE 196 36 040 A1, it is proposed to achieve a rich exhaust-gas mixture for the regeneration of an $NO_x$ storage device by increasing an exhaust gas recirculation rate. In the event of relatively high loads on the internal combustion engine, in particular $\geqq 20\%$ of the rated output, it is proposed to reduce the ratio of recirculated exhaust gas to intake air in order to counteract a power drop.

DE 199 14 787 A1 describes an exhaust-gas cleaning system for a diesel engine, in which a reducing agent is injected into the exhaust line in order to regenerate an $NO_x$ storage device and the exhaust-gas flow quantity is reduced using an exhaust-gas throttle valve. Since a regeneration mode of this type increases the pump losses of the engine, reduces the engine output and therefore causes a sudden change in torque, the quantity of fuel injected into the combustion chamber and the degree of opening of an exhaust-gas recirculation valve are increased, in order to ensure the same engine power as before the reduction in the exhaust-gas flow quantity.

It is the object of the invention to provide a method for operating a diesel engine and a diesel engine in which it is possible to switch between a lean mode and a rich mode of the diesel engine without the driver noticing, a switch over and without losses of driving comfort.

SUMMARY OF THE INVENTION

In a method for operating a diesel engine and a diesel engine, wherein engine emission control is provided by switching between a lean mode with superstoichiometric combustion air ratio $\lambda>1$ and a rich mode with substoichiometric combustion air ratio $\lambda<1$, the engine-torque fluctuations during the switching are determined and engine parameters which influence the engine torque, are adjusted so as to keep the engine torque constant during the switchover.

It is possible to react immediately to changes in torque which have an adverse effect on driving comfort by determining engine-torque fluctuations during switching. Tn combination with the measure of keeping the engine torque constant during the switching by adjusting parameters which influence the engine torque, it is possible to switch into rich mode even at a high engine load and under non-steady-state operating conditions without the switch-over being noticed by a driver. The determination of engine-torque fluctuations which are actually occurring also makes it possible to compensate for the effects of manufacturing tolerances and wear on sudden changes in torque during switching.

A comparison between rich mode and lean mode is made possible by recording a driving state in the rich mode, determining an engine torque which is present at the recorded driving state in lean mode and adjusting an engine torque which is present at the recorded driving state in the rich mode to the engine torque as determined for the lean mode. By adjusting the parameters which influence the engine torque, it is possible to achieve the same engine torque in the rich mode as with a corresponding driving state in lean mode, so that a driver does not notice which operating mode has been set. The driving state can be determined by the engine speed and the accelerator pedal position. A method of this type also makes it possible to detect manufacturing tolerances between different engines and to detect wear, by comparing lean and rich engine operating modes.

Even in the rich engine operating mode, a load change can be achieved within wide ranges as a result of the engine changing from a fuel-governed mixture formation method to an air mass-governed mixture formation method during the switching from the lean mode to the rich mode. Control in the rich mode by adjusting the air mass flow instead of adjusting the fuel quantity, as in the lean mode, is advantageous, since in a diesel engine, in the rich mode, it is scarcely possible to achieve changes in load by varying the fuel quantity. The change between a fuel-governed mixture formation method and an air mass-governed mixture formation method may take place continuously or discontinuously.

The adjustment of the parameters which influence the engine torque involves adjusting an administered air mass flow. This may be effected by a throttle device in the intake path, e.g. an electrically or pneumatically actuated valve or a throttle flap. A means for determining the air mass, e.g. a hot film air mass flow meter, may be provided.

A further parameter which affects the engine torque is an exhaust gas recirculation rate, which can be adjusted using an electrically or pneumatically actuated exhaust gas recirculation valve. An exhaust gas recirculation cooler may also be provided.

The engine torque is also influenced by the adjustment of an intake-pipe pressure, which is adjusted, for example, by means of a throttle device in the intake path, an exhaust gas recirculation and a supercharging device, such as a turbocharger.

Further parameters which influence the engine torque are exhaust gas back pressure, start of injection and injection quantity. There are possibilities for varying the injection operation with regard to pre-injection, main injection and after-injection, for example in such a way that after-injected fuel can no longer participate in the combustion.

A comfortable driving mode is also achieved by the fact that the switching between the lean mode and the rich mode is delayed in time when unfavorable boundary conditions are present.

A neutral transition is promoted by the fact that parameters which relate to an air path are adjusted before the change from the fuel-governed mixture formation method to the air mass-governed mixture formation method. By way of example, a throttle flap and an exhaust gas recirculation valve are moved into the position required for the air mass-governed mixture formation method even before the change to the air mass-governed mixture formation method takes place.

If the parameters which influence the engine torque are changed by means of an adaptive closed-loop control or an adaptive open-loop control, it is possible to achieve more rapid adaptation of the engine torque, since it is possible to proceed from values which have been preset by adaptation.

A diesel engine according to the invention has an engine-speed sensor and/or an engine-torque sensor. This, in particular with a high-resolution engine-speed sensor, forms the basis for accurate determination of fluctuations in the engine torque. The administered air mass, the intake-pipe pressure and/or the exhaust gas recirculation rate can be influenced using a throttle device with a first actuator in the intake path and/or an exhaust-gas recirculation device with an exhaust-gas recirculation valve with a second actuator. Fluctuations in engine torque and the adjustments to the parameters influencing the engine torque which are required in order to keep the engine torque constant are determined in an engine management unit, which also controls the actuators by means of suitable signals, switches between lean mode and rich mode, determines fluctuations in engine torque and controls the engine torque. The exhaust gas recirculation valve may be arranged upstream or downstream of the throttle means in the intake path.

The diesel engine advantageously has a supercharging device which is connected to the intake path, for example a turbocharger, with a third actuator which can be driven by the engine management unit. The engine management unit and the third actuator can be used, at an exhaust turbocharger, for example to adjust a boost pressure in the intake path, an exhaust gas back pressure, a free-flow cross section and an exhaust gas flow volume.

An accurate adjustment of the air mass flow is promoted by a means for changing an intake cross section of each cylinder, using a fourth actuator which can be operated by the engine management unit. A means of this type may, for example, be designed as an individual throttle flap in the intake section of each cylinder.

The invention will become more readily apparent from the following description thereof in connection with the drawings:

DESCRIPTION OF PREFERRED EMBODIMENTS

Figure 1:
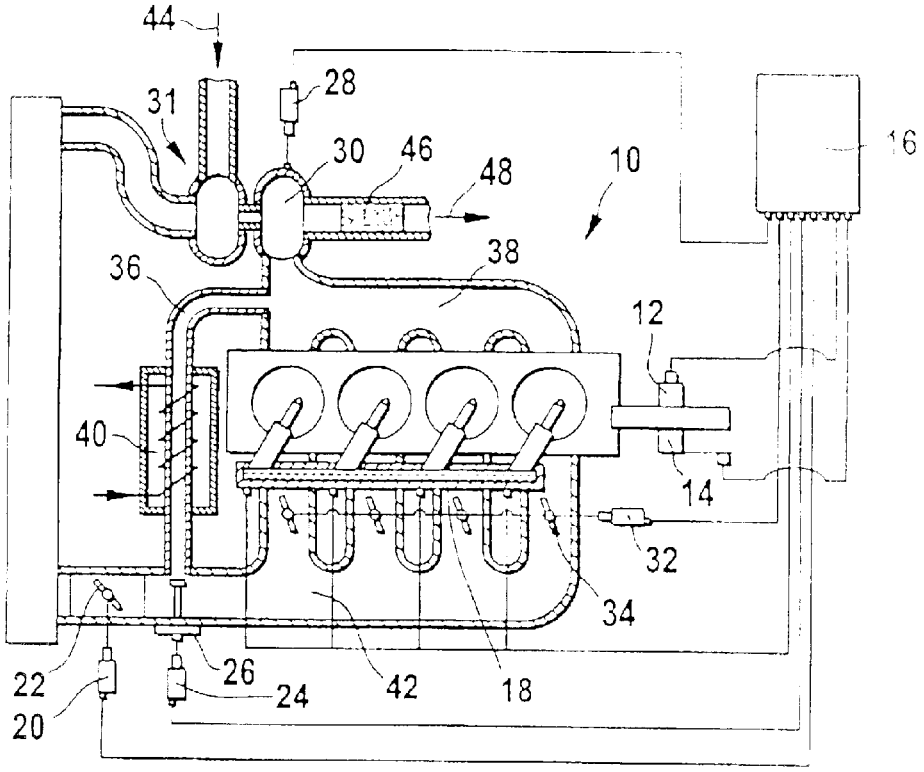
FIG. 1 diagrammatically depicts a diesel engine according to the present invention, and FIG. 2 diagrammatically depicts steps involved in the method according to the invention.

A diesel engine 10 which is diagrammatically depicted in FIG. 1 has an engine-speed sensor 12 and an engine-torque sensor 14. The engine-speed sensor 12 and the engine-torque sensor 14 are connected to an engine management unit 16. The engine management unit 16 uses the signals from the engine-speed sensor 12 and the engine-torque sensor 14 to determine any fluctuations in engine torque.

The engine management unit 16 controls a fuel injection installation 18, a throttle flap 22 by means of a first actuator 20, an exhaust-gas recirculation valve 26 by means of a second actuator 24, the exhaust-gas turbine 30 of an exhaust-gas turbocharger 31 by means of a third actuator 28 and individual throttle flaps 34 in the intake path of each cylinder by means of a fourth actuator 32. The exhaust-gas recirculation valve 26 opens and closes an exhaust-gas recirculation duct 36 which leads from an exhaust manifold 38, passes through an exhaust-gas recirculation cooler 40 and extends to the intake duct 42 of the diesel engine 10. The entry of fresh air into the intake duct 42 of the diesel engine 10 is denoted by an arrow 44. The fresh air which enters at 44 passes through a compressor of the exhaust-gas turbocharger 31, the throttle flap 22 and the exhaust-gas recirculation valve 26 and moves past the individual throttle flaps 34 in the intake duct of each cylinder and into the combustion chambers of the cylinders. Exhaust gas which is discharged from the combustion chamber flows through the exhaust manifold 38 into the exhaust-gas turbine 30, passes through an $NO_x$ adsorber 46 and leaves the diesel engine 10 at the location indicated by an arrow 48.

With the aid of the engine management system 16, the diesel engine 10 can be switched between a lean mode with superstoichiometric combustion air ratio $\lambda>1$ and a rich mode with a substoichiometric combustion air ratio $\lambda<1$. For this purpose, the engine management system 16, by way of example, increases the fuel quantity injected by the injection installation 18 and, at the same time, reduces the administered air mass by means of the actuator 20 and the throttle flap 22. It is necessary for the diesel engine 10 to be operated in a rich mode from time to time in order to regenerate the $NO_x$ adsorber. To allow switching between lean mode and rich mode of this type to take place without the driver noticing, the engine management system 16 uses the signals from the engine-speed sensor 12 and/or the signals from the engine-torque sensor 14 to determine fluctuations in engine torque which occur during the switching. If the engine management unit 16 detects fluctuations in the engine torque, it keeps the engine torque constant during switching by emitting signals for adjusting parameters which influence the engine torque to the first, second, third and fourth actuators 20, 24, 28, 32 and to the injection installation 18.

Such parameters are an administered air mass flow, which can be changed by adjusting the throttle flap 22, the individual throttle flaps 34, the exhaust-gas recirculation valve 26 and the exhaust-gas turbocharger 31. The administered air mass flow is measured, for example, by means of a hot-film air mass flow meter (not shown) in the intake path 42. The engine torque is also influenced by the intake-pipe pressure in the intake path 42, which is changed by the engine management unit 16 by adjusting the exhaust-gas recirculation valve 26, the throttle flap 22, the individual throttle flaps 34 and the exhaust-gas turbocharger 31. Furthermore, the engine torque is affected by the exhaust-gas recirculation rate, which can be changed by the engine management unit 16 by adjusting the exhaust-gas recirculation valve 26, the throttle flap 22 and the exhaust-gas turbocharger 31. The engine management unit 16 also uses the injection installation 18 to change the start of injection and an injection quantity of the fuel in a pre-injection, main injection and after-injection, as further parameters which influence the engine torque. Finally, an exhaust gas back pressure influences the engine torque and can be adjusted by the engine management unit 16 with the aid of the actuator 28 at the exhaust-gas turbine 30.

In a lean mode, the diesel engine 10 is operated with a fuel-controlled mixture formation method by the engine management unit 16. In this case, the engine torque is controlled by adjusting the administered fuel quantity. During the switch from a lean mode to a rich mode of operation of the diesel engine 10, the engine management unit 16 changes to an air mass-governed mixture formation method. In this case, the engine torque is controlled by an adjustment in the controlled air mass flow. When the diesel engine 10 is in rich mode, only an air mass-governed mixture formation method of this type allows the engine torque to be controlled over the entire operating range of the diesel engine 10, since, in a rich mode, a load change in the diesel engine can scarcely be achieved by varying the fuel mass. Therefore, the engine management unit 16 can switch between lean mode and rich mode even in a non-steady-state operating conditions and/or at a high engine load without the switch-over being noticeable by a sudden change in torque. The transition from the fuel mass-governed mixture formation method to the air mass-governed mixture formation method and back takes place by means of continuous adjustment of all or some of the actuators 20, 24, 28, 32.

Even after the engine has been switched to rich mode, the engine management unit 16 evaluates the signals from the engine-speed sensor 12 and the engine-torque sensor 14 and assigns the engine torque which has been determined in this way to the current driving state, for example, engine speed and accelerator pedal position. This engine torque which is determined for a specific driving state in a rich mode is compared with an engine torque which would be provided in the recorded driving state in a lean mode. If the engine management unit determines a deviation in the engine torque in the rich mode compared to the lean mode, the engine torque which is present in the recorded driving state is adjusted to the engine torque which has been determined for the lean mode of operation. Comparing the two operating modes in this way makes it possible to detect both, manufacturing tolerances in engines and long-term shifts caused by aging or wear phenomena. Also, a driver does not notice whether the diesel engine 10 is currently running in the lean mode or in the rich mode.

Figure 2:
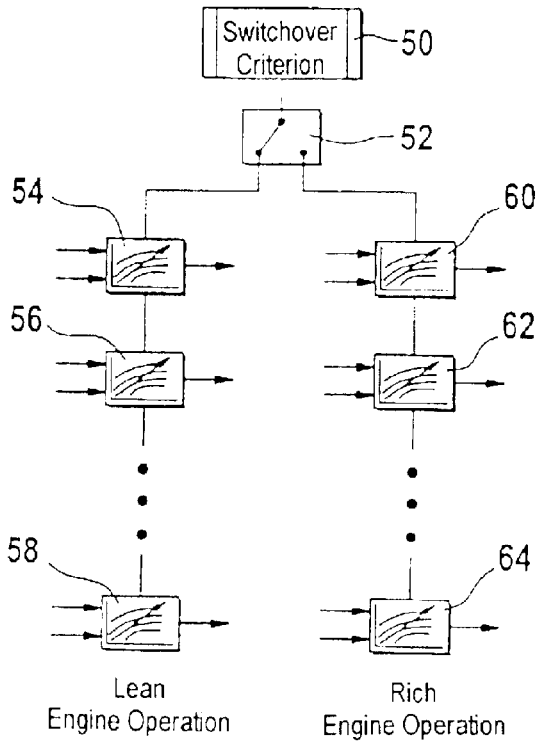

FIG. 2 diagrammatically depicts the sequence of the method according to the invention for operating the diesel engine 10. In step 50, the engine management unit 16 checks switching criteria for switching between the lean mode and the rich mode and vice versa. These criteria relate, for example, to the current storage capacity of the $NO_x$ adsorber 46 and the exhaust-gas temperature which is present, both these parameters being determined by means of suitable sensors and transmitted to the engine management unit 16. If the switching criteria are not fulfilled, the diesel engine 10 continues to be operated in the lean mode by the engine management unit 16, as illustrated in step 52. The control of the engine torque which takes place in the lean mode is indicated by step 54, 56 . . . 58, in which individual parameters which influence the engine torque, such as the intake-pipe pressure in the intake duct 42 and quantity of fuel injected by the injection installation 18 are adjusted in accordance with the fuel-governed mixture formation method which is used in the lean mode of operation.

On the other hand, if the switching criteria in step 50 are satisfied, the engine management unit 16 switches, in step 52, to the rich mode of the diesel engine 10 and changes to an air mass-governed mixture formation method. The control of the engine torque during switching, i.e. until a substoichiometric air ratio $\lambda<1$ is reached, and in the rich mode by adjustment of parameters which influence the engine torque, such as the administered air mass and the exhaust-gas recirculation rate, in accordance with the air mass-governed mixture formation method used in the rich mode, is indicated by the steps 60, 62 . . . 64. If the continuous checking of the switching criteria in step 50 shows that the switching criteria are no longer satisfied, the engine management unit 16, in step 52, switches back to the lean mode of the diesel engine 10. During this switching-back operation, the engine torque is still kept constant, so that the driver does not notice the switching operation.

In steps 54, 56, 58 and 60, 62, 64, the engine torque is controlled by adaptive closed-loop control. Adaptation allows the parameters which are to be adjusted to be preset to values from an expected range, so that minor changes are sufficient for the torque to be controlled.

What is claimed is:

1. A method for operating a diesel engine, involving switching between a lean mode of engine operation with superstoichiometric combustion air ratio $\lambda>1$ and a rich mode of engine operation with substoichiometric combustion air ratio $\lambda<1$, said method comprising the steps of:

determining engine torque fluctuations during the switching, and controlling the engine torque during the switching by adjusting parameters which influence the engine torque so as to keep engine torque constant.

2. A method for operating a diesel engine according to claim 1, comprising the additional steps of:

recording a driving state in the rich engine operating mode, determining an engine torque which is provided at the recorded driving state in the lean engine operating mode, and adjusting the engine torque which is provided at the recorded driving state in the rich mode to the engine torque determined for the lean mode by adjusting the parameters which influence the engine torque.

3. A method for operating a diesel engine according to claim 1, wherein, during the switching from the lean mode to the rich mode, the method for operating the engine is changed from a fuel-governed mixture formation method to an air mass flow-governed mixture formation method.

4. A method for operating a diesel engine according to claim 3, wherein parameters relating to an air mass flow path are adjusted before the change from the fuel-governed mixture formation method to the air mass-governed mixture formation method.

5. A method for operating a diesel engine according to claim 1, wherein, for the adjustment of the parameters which influence the engine torque, the air mass flow is controlled.

6. A method for operating a diesel engine according to claim 1, wherein, for the adjustment of the parameters which influence the engine torque, the exhaust gas recirculation rate is controlled.

7. A method for operating a diesel engine according to claim 1, wherein, for the adjustment of the parameters which influence the engine torque, the air intake-duct pressure is controlled.

8. A method for operating a diesel engine according to claim 1, wherein, for the adjustment of the parameters which influence the engine torque, the exhaust gas back pressure is controlled.

9. A method for operating a diesel engine according to claim 1, wherein, for the adjustment of the parameters which influence the engine torque, the start of fuel injection is controlled.

10. A method for operating a diesel engine according to claim 1, wherein, for the adjustment of the parameters which influence the engine torque, the fuel injection quantity is controlled.

11. A method for operating a diesel engine according to claim 1, wherein switching between the lean mode and the rich mode of engine operation is delayed if unfavorable switch-over conditions are present.

12. A method for operating a diesel engine according to claim 1, wherein the adjustment of the parameters which influence the engine torque is effected by one of adaptive closed-loop control and adaptive open-loop control.

13. A Diesel engine for carrying out a method for operating a Diesel engine by switching between lean and rich modes of engine operation, said engine including at least one of an engine-speed sensor, an engine-torque sensor, and a throttle device with a first actuator in the intake duct of said engine and an exhaust-gas recirculation device with an exhaust-gas recirculation valve having a second actuator, and an engine management unit, which is coupled to the engine-speed sensor and the engine-torque sensor and the first actuator, and the second actuator, said engine management unit switching between the lean mode and the rich mode of engine operation, to determine engine-torque fluctuations and controlling the engine torque, so as to be constant.

14. A Diesel engine according to claim 13, including a supercharging device, which is connected to the intake duct and has a third actuator, which is operated by the engine management unit.

15. A Diesel engine according to claim 13, including a flow control means for changing an intake cross section of each cylinder of said engine and having a fourth actuator which is operated by the engine management unit.

* * * * *